US010036612B2

(12) United States Patent
Hamm et al.

(10) Patent No.: US 10,036,612 B2
(45) Date of Patent: Jul. 31, 2018

(54) SIGHT

(71) Applicants: Harold M. Hamm, Wisconsin Rapids, WI (US); Brian H. Hamm, Wisconsin Rapids, WI (US); Christopher A. Hamm, Wisconsin Rapids, WI (US)

(72) Inventors: Harold M. Hamm, Wisconsin Rapids, WI (US); Brian H. Hamm, Wisconsin Rapids, WI (US); Christopher A. Hamm, Wisconsin Rapids, WI (US)

( * ) Notice: Subject to any disclaimer, the term of this patent is extended or adjusted under 35 U.S.C. 154(b) by 134 days.

(21) Appl. No.: 14/873,917

(22) Filed: Oct. 2, 2015

(65) Prior Publication Data

US 2016/0025456 A1 Jan. 28, 2016

Related U.S. Application Data

(63) Continuation-in-part of application No. 14/061,216, filed on Oct. 23, 2013, now Pat. No. 9,453,709.

(60) Provisional application No. 61/718,474, filed on Oct. 25, 2012.

(51) Int. Cl.

| | |
|---|---|
| ***F41G 1/38*** | (2006.01) |
| ***F41G 1/467*** | (2006.01) |
| ***F41G 1/387*** | (2006.01) |
| ***F41G 1/40*** | (2006.01) |
| ***F41G 1/41*** | (2006.01) |

(52) U.S. Cl.

CPC ..... *F41G 1/467* (2013.01); *F41G 1/38* (2013.01); *F41G 1/387* (2013.01); *F41G 1/40* (2013.01); *F41G 1/41* (2013.01)

(58) Field of Classification Search

CPC ..... F41G 1/24; F41G 1/033; F41G 1/467

See application file for complete search history.

(56) References Cited

U.S. PATENT DOCUMENTS

| | | | | | |
|---|---|---|---|---|---|
| 656,867 | A | * | 8/1900 | Tolman | F41G 1/24 42/137 |
| 906,751 | A | | 12/1908 | Swasey | |
| 1,330,002 | A | | 2/1920 | Price | |
| 1,407,208 | A | | 2/1922 | Cassel | |
| 1,451,584 | A | * | 4/1923 | Mapes | F41G 1/24 42/137 |
| 2,155,391 | A | | 4/1939 | Arden | |
| 2,545,454 | A | | 3/1951 | Fredrickson | |
| 2,671,966 | A | * | 3/1954 | Jacobsen | F41G 1/08 42/133 |

(Continued)

FOREIGN PATENT DOCUMENTS

DE 191018847 8/1909

OTHER PUBLICATIONS http://www.hhasports.com/catalog/l/optimizer-lite-ultra/; website screenshot for the Optimizer Lite Ultra; Dec. 21, 2014.

(Continued)

*Primary Examiner* — Gabriel J Klein

(74) *Attorney, Agent, or Firm* — Shane Delsman; Godfrey & Kahn, S.C.

(57) ABSTRACT

A sight apparatus with a rack and pinion mechanism, used to raise or lower a scope head and/or sight pin. The sight apparatus may also include a number of adjustment mechanisms for pivotally adjusting the sight, a locking mechanism and selectively interchangeable spools, e.g. spools for different arrow velocity and/or trajectory.

18 Claims, 7 Drawing Sheets

(56) References Cited

U.S. PATENT DOCUMENTS

| | | | | |
|---|---|---|---|---|
| 3,599,337 | A * | 8/1971 | Snodgrass | F41G 1/24 42/136 |
| 4,567,668 | A * | 2/1986 | King | F41G 1/467 33/265 |
| 4,961,265 | A | 10/1990 | Roberts | |
| 5,117,804 | A * | 6/1992 | Jorlov | F41G 1/467 124/87 |
| 5,718,215 | A * | 2/1998 | Kenny | F41G 1/467 124/87 |
| 5,975,069 | A | 11/1999 | Hamm | |
| 6,073,351 | A * | 6/2000 | Barnett | F41G 1/467 42/136 |
| 6,591,538 | B2 | 7/2003 | Holler | |
| 6,609,306 | B2 * | 8/2003 | Johnson | F41G 1/467 124/87 |
| 6,823,597 | B2 | 11/2004 | Larson | |
| 7,278,216 | B2 | 10/2007 | Grace | |
| 7,360,313 | B1 | 4/2008 | Hamm | |
| 7,475,485 | B1 | 1/2009 | Hamm | |
| 7,520,083 | B2 | 4/2009 | Dextraze | |
| 7,900,365 | B1 * | 3/2011 | Johnson | F41G 1/467 33/265 |
| 8,079,171 | B2 | 12/2011 | Barret | |
| 8,240,075 | B1 | 8/2012 | Mullin | |
| 8,528,140 | B1 | 9/2013 | Phillips | |
| 8,707,606 | B2 | 4/2014 | Hoel | |
| 2010/0162611 | A1 | 7/2010 | Samson | |
| 2015/0075016 | A1 | 3/2015 | Wassmer | |

OTHER PUBLICATIONS http://www.hhasports.com/catalog/4/optimizer-lite/; website screenshot for the Optimizer Lite; Dec. 21, 2014.

http://www.hhasports.com/catalog/3/optimizer-lite-cadet/; website screenshot for the Optimizer Lite Cadet; Dec. 21, 2014.

http://www.hhasports.comicatalog/5/brushfire/; website screenshot for the Brushfire; Dec. 21, 2014.

http://www.hhasports.com/catalog/14/pro-series/; website screenshot for the Pro Series; Dec. 21, 2014.

Spot Hogg Catalog, 2011.

* cited by examiner

SIGHT

CROSS REFERENCE TO RELATED APPLICATIONS

This application is a continuation in part of U.S. application Ser. No. 14/061,216, filed Oct. 23, 2013, which claims the benefit of and priority to U.S. Provisional Patent Application Ser. No. 61/718,474, filed on Oct. 25, 2012, the disclosure of which are hereby incorporated by reference herein in their entirety for all purposes.

FIELD OF THE INVENTION

This invention relates generally to a sight for a firearm, bow or other similar type of weapon or equipment. More particularly, the present invention relates to a vertically adjustable sight.

BACKGROUND

Vertically adjustable sights, for example, those used in the field of archery, are known to be adjustable to account for many external factors, e.g. the distance to the target. Some current sights use cam members or other such mechanisms to adjust the sighting element, such as a sight pin, which can be inaccurate and/or hinder the ability to lock the sight pin at a select adjustment. Some current sights are also not adaptable to many different sizes of firearms, bows or other similar type of weapon or equipment.

One sight designed to overcome such problems is disclosed in U.S. Pat. No. 7,360,313, which is hereby incorporated by reference herein in its entirety for all purposes, and shares common inventorship and ownership with the present invention. The sight disclosed in U.S. Pat. No. 7,360,313 utilizes a gearing system to adjust the sight pin, includes a locking mechanism to prevent the sight pin from undesired movement and is adaptable for number of different sized bows. However, the sight includes a number of moving pieces to translate the desired adjustment as indicated by the use of an adjustment mechanism, e.g. a dial, to the sight pin.

Having many moving parts in such a sight increases the cost to manufacture both from a materials and assembly perspective. Having many moving parts also increases: (1) the failure rate by having an increased number of parts that could have defects, (2) the wear on the moving parts and (3) the opportunity for external elements to affect a part of the mechanism, e.g. dirt or debris. For example, having a number of slots within which selected parts move presents multiple opportunities for dirt, debris, rain, snow or other elements to interfere with the operation thereof. Having many moving parts can also increase the weight of the sight and, thereby, the weight of the object to which the sight is attached, for example a bow, which can affect accuracy due to fatigue in holding the bow.

As such, there is a need for a selectively lockable, geared, adjustable sight that has a minimum number of moving parts.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

SUMMARY OF THE INVENTION

In one embodiment, the invention provides a sight that is vertically adjustable. The sight includes a sight for a bow includes a frame for mounting the sight to the bow and a dial rotatably connected to the frame. A pinion is attached to the dial such that when the dial rotates the pinion rotates. A rack is engaged with the pinion, such that when the pinion rotates in a first direction the rack is raised and when the pinion is rotated in a second direction the rack is lowered. A sight housing is attached to the rack such that the sight housing moves with the rack.

In another embodiment, a wheel is rotatably connected to a housing, and a linear gear bar slidably retained within the housing. A circular gear is connected to the wheel such that when the wheel is rotated the circular gear is rotated. A sight pin is connected to the linear gear bar and the linear gear bar is engaged with the circular gear, wherein rotation of the wheel causes linear motion of the sight pin.

In another embodiment, a sight includes a housing. The housing includes a mounting portion for attaching the sight to a bow, an adjustable portion connected to the mounting portion, and a side plate connected to the adjustable portion. The adjustable portion has an aperture formed therein, and a top and bottom bushing and a top and bottom washer that are secured to the adjustable portion. The side plate has an adjustable top plate and an adjustable bottom plate. A vertical gear has a vertical slot formed therein and the top and bottom bushing are slidably received in the vertical slot. The vertical gear is held between the side plate and adjustable portion by the top and bottom washers and the adjustable top and bottom plates. A cylindrical handle is connected to at least one of the side plate and adjustable portion by a post and has a spur gear located within the aperture that is engaged with the vertical gear. A lock nut is threaded onto the post and secured to the post by an inset screw threaded into a bore of the lock nut. A washer is sized to snugly fit around the lock nut, and a wing nut is threaded onto the post. When the wing nut is tightened, the wing nut contacts the washer to thereby prevent the cylindrical handle from rotating with respect to the post. An intermediate member is rotatably connected to the vertical gear by a fastener, and a scope head is attached to the intermediate member. When the fastener is loosened, the intermediate member and scope head can be rotated about the fastener, and when the fastener is tightened, the intermediate member and scope head cannot be rotated. When the cylindrical handle is rotated in a first direction, the spur gear is rotated in the first direction, and the engagement between the spur gear and the vertical gear causes the vertical gear and scope head to move upward. When the cylindrical handle is rotated in a second direction, the spur gear is rotated in the second direction and the engagement between the spur gear and the vertical gear causes the vertical gear and scope head to move downward.

Other objects and advantages of the invention will become apparent hereinafter.

DETAILED DESCRIPTION

Figure 1:
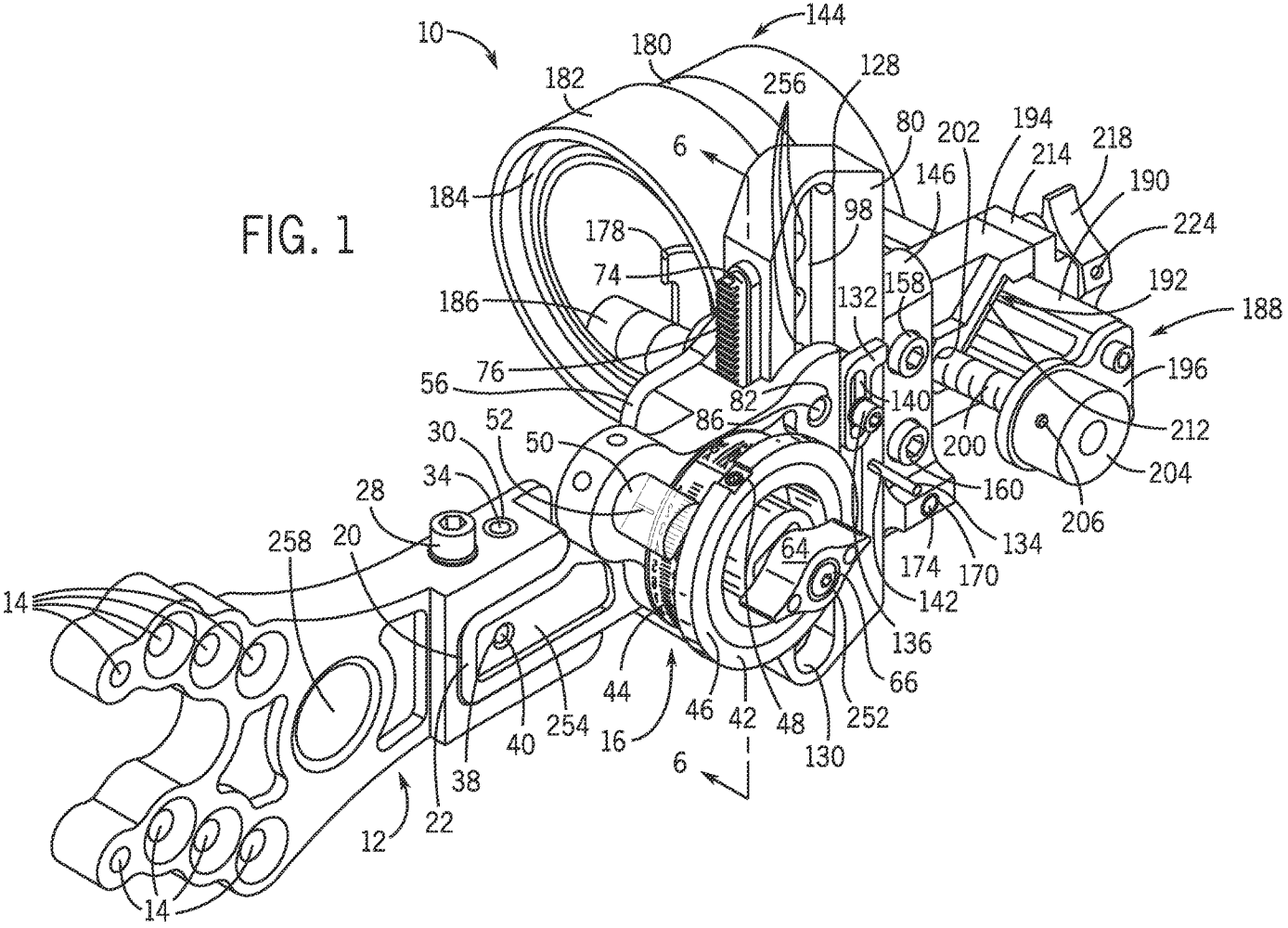
FIG. 1 is a perspective view of a sight apparatus in accordance with the present invention.
Figure 2:
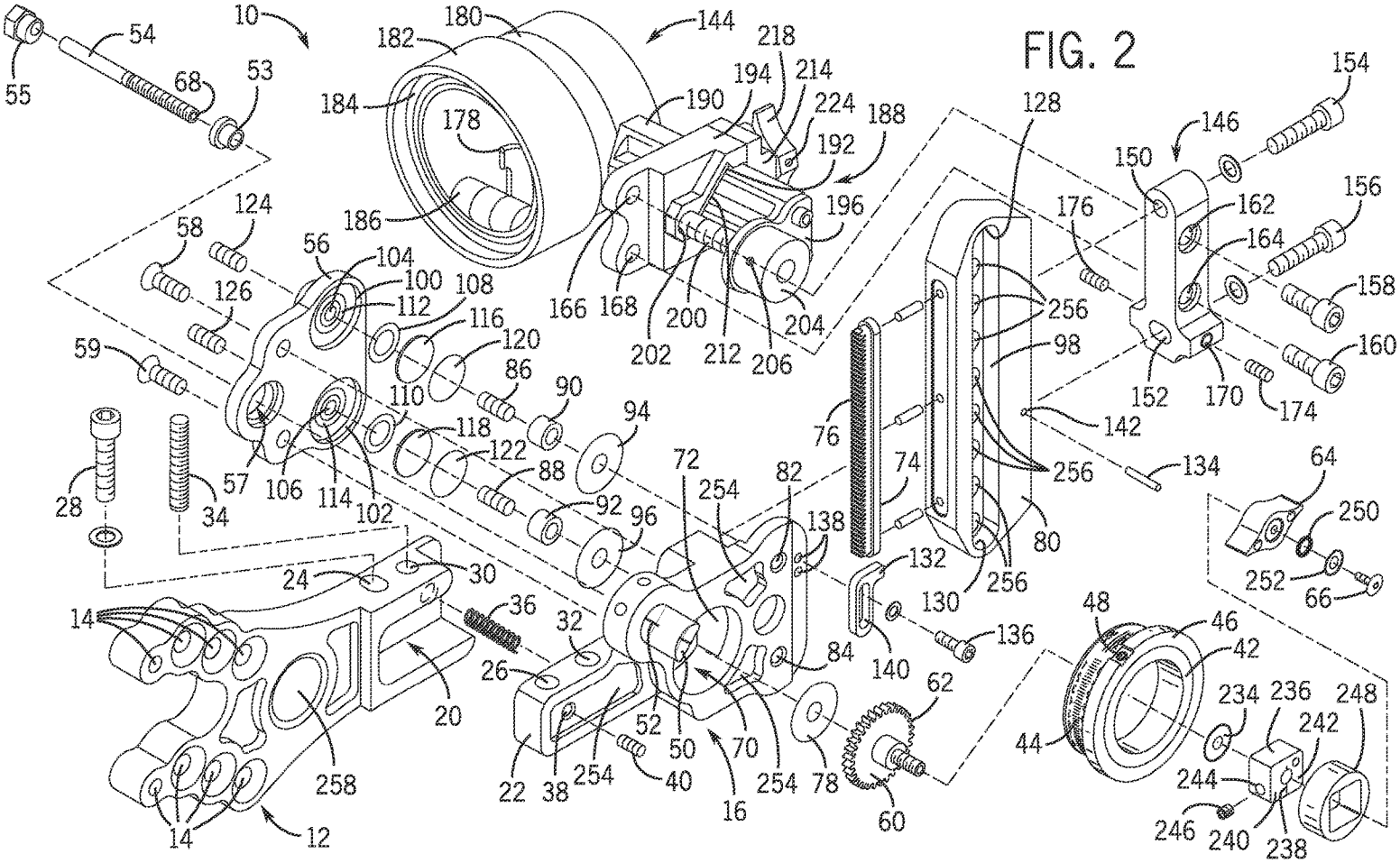
FIG. 2 is an exploded perspective view of the sight apparatus of FIG. 1.
Figure 3:
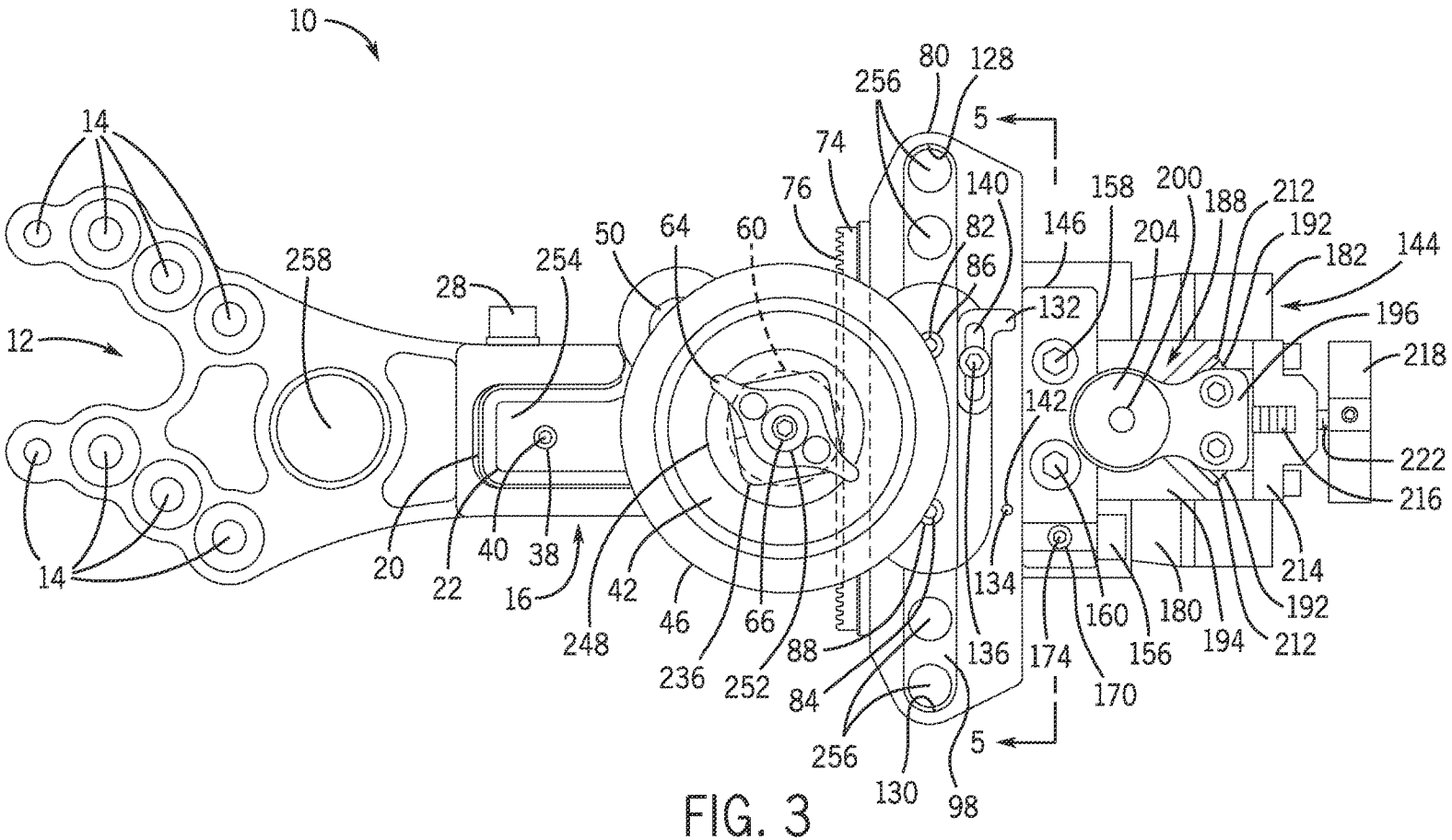
FIG. 3 is a side elevation view of the sight apparatus of FIG. 1.
Figure 4:
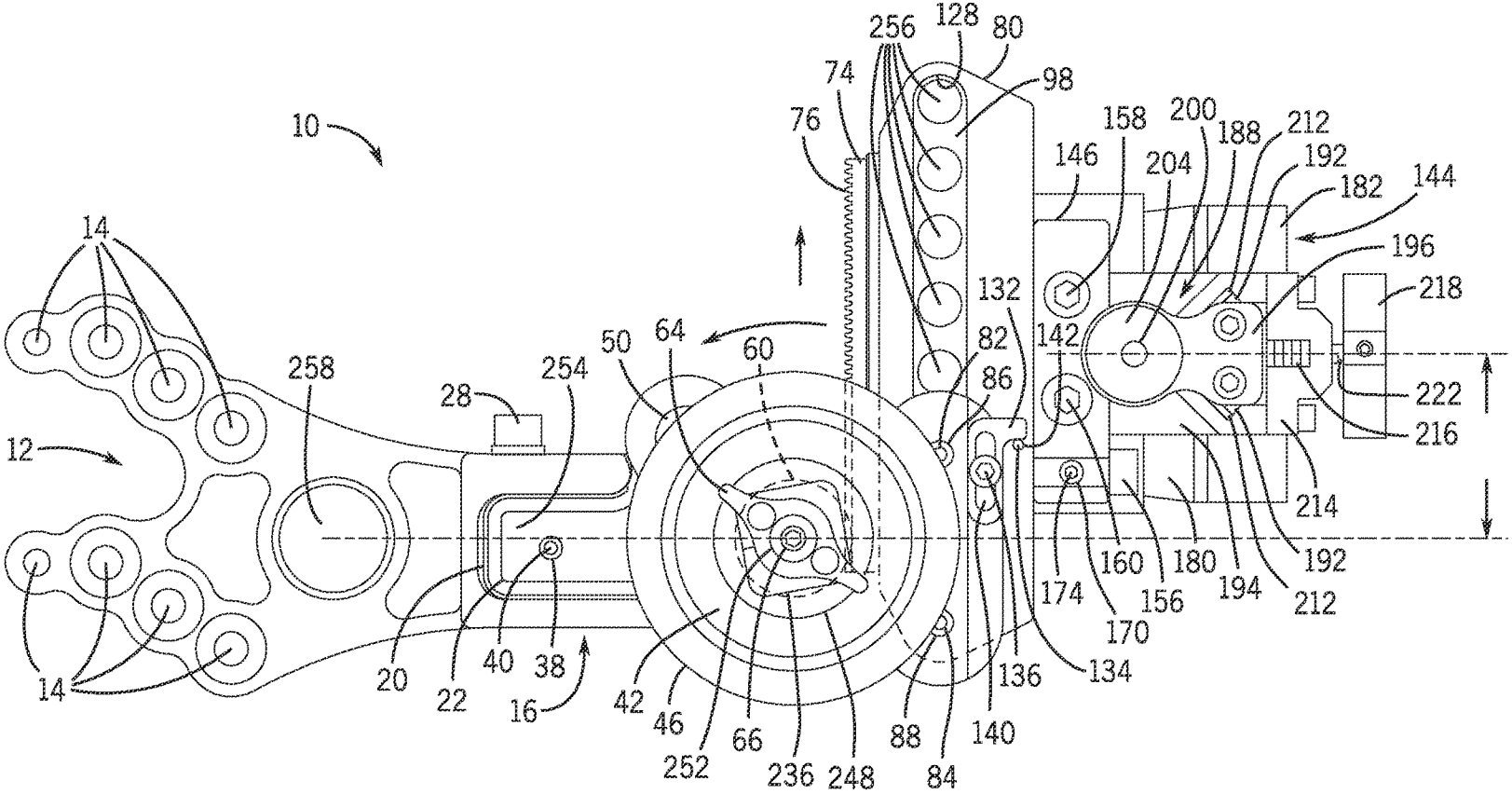
FIG. 4 is a side elevation view of the sight apparatus of FIG. 3 with the scope head having been raised as compared to the sight apparatus of FIG. 3.

The sight apparatus 10, as shown in FIGS. 1-9, adjusts a sight pin 178 through a rack and pinion mechanism. The sight apparatus 10 has a housing or frame that can include a number of members or portions, as seen in FIG. 1. One portion of the frame as best seen in FIG. 2, is a mounting member or bracket 12 which has a variety of mounting holes 14 that permit the sight apparatus 10 to be attached to a variety of firearms, weapons or equipment, in this example a bow, in a variety of positions. Another portion of the frame shown in FIG. 2 is an adjustable member or portion 16 that is adjustably connected to the mounting member 12. The frame could also be integrally formed or any number of the portions combined or integrally formed. For example, the adjustable member 16 could include a mounting portion so as to create a single or first part of the frame and the second part of the frame could be a side plate 56.

In the embodiment shown in FIGS. 1-9, the sight apparatus 10 includes a number of correction mechanisms, designed to permit the sight apparatus to be adjusted in a number of ways such that the sight may be very finely calibrated. Some equipment may not need such fine calibration and therefore, may not need as many or any such correction mechanisms. One such correction mechanism permits adjustment to the line of sight through a scope head 144.

For example, as seen in FIG. 2, the mounting member 12 may have a cavity or aperture 20 sized and shaped to receive the end 22 of the adjustable member 16. The mounting member 12 has an elongated hole 24 that generally aligns with a threaded hole 26 in the adjustable member 16 to receive a fastener 28 when the end 22 of the adjustable member is received within the cavity 20. The mounting member has another hole 30 that aligns with a second hole 32 in the adjustable member 16 to receive a pin 34 when the end 22 of the adjustable member is received within the cavity 20. Between the end 22 of the adjustable member 16 and the mounting member 12 is a spring 36 to pull the adjustable member towards the mounting member when the fastener 28 is not fully tightened. The adjustable member 16 also has a threaded hole 38 in its side which receives a fastener 40, for example a threaded insert.

When the fastener 28 is not tightly secured, the mounting member 12, the adjustable member 16, and thereby the forward portions of the sight apparatus 10, can be adjusted with respect to the mounting member 12, and thereby the equipment to which the mounting member is mounted, e.g. a bow. The elongated hole 24 allows the adjustable member 16 to be rotated about the pin 34 because as the adjustable member is moved, the fastener 28 can move within the elongated hole. This allows the sight apparatus 10 to be adjusted based upon the equipment to which it is attached and to account for minor deviations in manufacturing and assembly.

For micro-adjustment, the fastener 28 can be loosened and the threaded insert 40 screwed further into the hole 38 until the threaded insert contacts the mounting member 12. As the threaded insert 40 is further screwed into the hole 38, the end 22 of the adjustable member 16 will be pushed further away from the mounting member 12, overcoming the force of the spring 36, to rotate the adjustable member and the forward portions of the sight apparatus 10 by very small and closely controlled amounts.

The adjustable member 16 also includes a cylindrical handle such as wheel or dial 42 that can have markings 44 such as minutes of angle, distances or any other indicia. For example, for a bow, the indicia could be specifically correlated to distances for the draw strength, elevation, arrow and/or any other condition which might affect the flight pattern of the arrow. Alternatively, the markings 44 could be selectively removed and attached to the wheel 42, such as by being on a tape or strip of material that could be wrapped around and attached to the wheel or a removable spool 46, which could be secured to the wheel 42 by a fastener 48, for example, an inset screw.

Having removable markings or measurement systems 44 and/or spools 46 allows the sight apparatus 10 to be easily adaptable to a given factor or factors such as those described above or others including altitude, humidity, temperature, wind, atmospheric pressure, arrow velocity, trajectory, etc. To make the selected indicia 44 more easily seen, the adjustable member 16 may also have an indicator 50. The indicator 50 may be magnified and may have a pointer 52. The pointer 52 could be a simple line or arrow or may be made from a material that is easy to see in low light conditions, for example, fiber optic materials.

One embodiment of the present invention includes the translation of rotation from a dial to linear movement of the sight pin 178. One way to accomplish such translation is through a rack-and-pinion or drum-and-slide mechanism. The drum could be a circular or pinion gear 60 connected to the wheel 42, which pinion gear engages the linear gear bar or rack 74 of a slide 80, the slide being connected to the sight pin 178 as discussed further below. The drum could also be a hard round drum with a rough or coarse surface that engages the softer material, e.g. rubber, polymer such as Delrin, plastic, etc., of a slide bar, the slide being connected to the sight pin 178. The entire slide 80 could be made from a material softer than the drum or just the portion that engages the drum. The engagement between the drum and slide causes the slide 80, and thereby the sight pin 178, to move up and down in response to rotation of the drum, e.g. by rotation of the dial or wheel.

In the embodiment shown in FIG. 1, the wheel 42 is of a type disclosed and described in U.S. application Ser. No. 14/061,216. In addition to the wheel disclosed and described in U.S. application Ser. No. 14/061,216, the wheel 42 shown in FIG. 1 is attached to a gear. As seen most clearly in FIG. 2, the peg, post or pin 54 on which the wheel 42 resides and rotates about is secured to side plate 56. Alternatively, the peg 54 could also be attached or formed with the adjustment member 16. The peg 54 may have an un-threaded portion on which the wheel may rotate and a threaded portion which is used to attach the wheel to the peg, as will be discussed in more detail below.

In the embodiment shown in FIG. 2, the peg 54 is secured to a nut 55 with a collar, the nut 55 of course having a threaded opening. In the nut 55, however, the threaded opening is offset or eccentric from the center of the nut, rather than centered as is usually the case. The peg 54 is secured in the hole of the nut 55, and thus is offset with respect to the nut. A hat bushing 53 is press-fit into an opening 57 in the side plate 56. The nut 55 is then press fit into the hat bushing 53 to rotatably hold the nut and peg 54 to the side plate 56. The offset attachment of the peg 54 to the nut 55 allows the position of the peg to be moved by rotation of the nut as will be discussed in more detail below.

The side plate 56 is attached to the adjustment member 16 by two fasteners 58, 59. When the side plate 56 is attached to the adjustment member 16, the peg 54 then extends through the adjustment member 16. The circular, spur or pinion gear 60 is attached to the wheel 42, such as by threading the gear to a hole in the wheel. There are a number of known methods for connecting such parts, for example, fastening, welding, adhering, etc., the use of which would not defeat the spirit of the invention.

The gear 60 has a bore through which the peg 54 may extend. The peg 54 also extends through the wheel 42 and engages with a lock knob or wing nut 64. A screw or other threaded fastener 66 is threaded into a threaded opening 68 in the end of the peg 54 to rotatably retain the wheel 42 and gear 60 as described in more detail below. The wing nut 64 is part of locking system or means that is used to selectively lock the wheel 42 in a desired position. For example, the locking means may be movable between a first position, by turning the wing nut 64 clockwise, toward a position where the wheel 42 is prevented from rotating, and a second position, by turning the wing nut counter-clockwise, toward a position which allows the wheel to be rotated. In neither case does the rotation of the locking means move the wheel, in moving the locking means between the first and second positions.

When assembled, the gear 60 is held within an enclosure 70 of the adjustment member 16. The enclosure 70 shown in FIG. 2 has an opening 72 which exposes the teeth 62 of the gear 60 such that the teeth can engage with the rack 74 as will be discussed in more detail below. A washer 78 can also be placed on the peg 54 between the gear 60 and the adjustable member 16 to allow the gear to rotate more freely. A silicone or other lubricant can also be used to permit the gear 60, and thereby the wheel 42, to rotate more freely.

As referenced above, the slide member 80 carries the rack gear, linear gear bar or vertical gear 74, which has a set of teeth 76 for engaging the teeth 62 of the gear 60. As seen in FIG. 2, the rack 74 can be set in a groove in the slide member 80 and attached with pins, such as press fit pins. The rack 74 could also be integrally formed with the slide member 80 or attached in a variety of other ways known in the industry, e.g. welding, riveting, adhering, etc. The slide member 80 is slidably held or retained between a first and second part of the housing, in this instance the side plate 56 and the adjustment member 16 in FIG. 2. The slide member 80 can also have a slot or groove in which a projection, for example, a bushing, from the housing is located.

Figure 7:
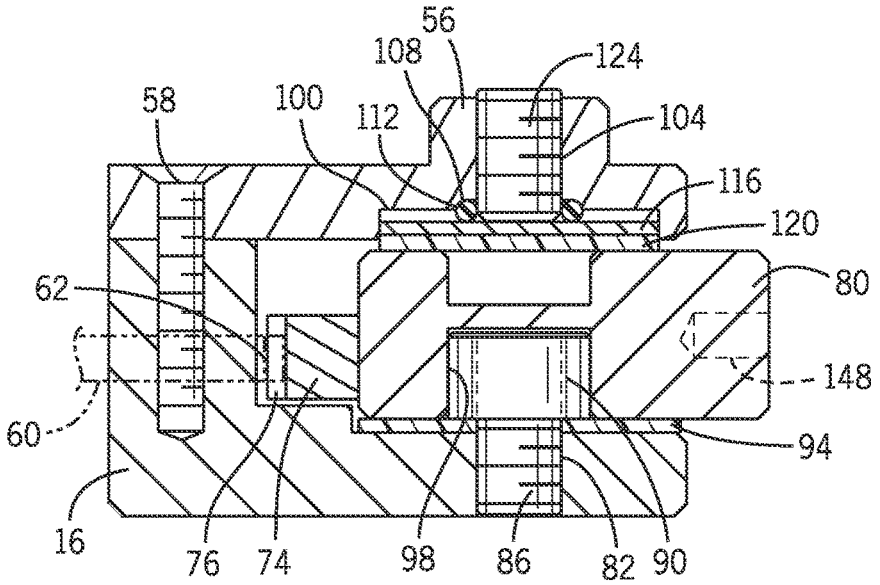
FIG. 7 is top plan cross-sectional view of the sight apparatus of FIG. 6 taken along the line 7-7.

In the embodiment shown, the adjustment member 16 has two vertically aligned holes 82, 84. A first fastener 86 extends through a first bushing 90 and a first washer 94 and into the first hole 82 to hold the first bushing and first washer to the adjustment member 16. A second fastener 88 extends through a second bushing 92 and a second washer 96 and into the second hole 84, to hold the second bushing and second washer to the adjustment member 16. When the sight apparatus 10 is assembled, the two bushings 90, 92 are located in a vertical slot 98 formed in the slide member 80 and the washers 94, 96 will both contact one side of the slide member as seen in FIGS. 2 and 7.

FIG. 2 illustrates two recesses 100, 102 which are located on the interior side of the side plate 56 with a threaded hole 104, 106 extending through the center of each recess. Within each recess 100, 102, an O-ring 108, 110 is located within a groove 112, 114 around the threaded holes 104, 106, respectively, such that only a portion of the O-ring extends into the recess as best seen in FIG. 7. A first plate 116, 118 is located in each recess 100, 102 against a respective O-ring 108, 110, and a second plate 120, 122 is respectively located on top of each first plate. The second plates 120, 122 will contact the slide member 80 when the sight apparatus 10 is assembled.

A fastener 124, 126 is inserted into each respective threaded hole 104, 106. The fasteners 124, 126 shown in FIG. 2 have no head such that their depth can be selectively set. The depth of the fasteners 124, 126 will selectively determine the ease with which the slide member 80 will slide. For example, when the fasteners 124, 126 extend into the recesses 100, 102, they push the first plates 116, 118, and thereby, the second plates 120, 122, respectively, into contact with the slide member 80 to sandwich the slide member between the second plates and the washers 94, 96. The deeper the fasteners 124, 126 are threaded into the threaded holes 104, 106, the further the first plates 116, 118 are pushed towards the second plates 120, 122, which are pushed further out of the recesses 100, 102, respectively, and into contact with the side of the slide member 80, causing greater friction between the slide member and the second plates and the washers 94, 96.

In the embodiment shown in FIG. 2, the O-rings 108, 110 perform several functions. The depth of the recesses 100, 102 in combination with the depth of the grooves 112, 114 in which the O-rings 108, 110 reside are sized in relation to the first plates 116, 118 and second plates 120, 122 such that when side plate 56 is attached to the adjustable member 16, the plates 116, 118, 120, 122 apply some pressure on the slide member 80. The fasteners 124, 126 can then be used to add additional pressure as described above. The O-rings 108, 110 also provide friction with the first plates 116, 118 to prevent the first plates from spinning as the slide member 80 is moved and keeps the first plates 116, 118, and thereby the second plates 120, 122 from tilting within the recess, such as when one of the fasteners 124, 126 contacts them.

The washers 94, 96 could also be separated from the bushings 90, 92 and be plates of similar configuration and perform similarly to the second plates 120, 122. The washers 94, 96 could be located in recesses in the adjustment member and employ threaded inserts to adjust the amount of force applied to the slide member 80, and thereby, the rack 74. The bushings 90, 92 could also be press fit into the slot 98 in addition to, or so as to avoid the need for, the side plate 56.

The bushings 90, 92, second plates 120, 122, and/or the washers 94, 96, 78 can be made of a low friction material, such as Teflon, nylon, or other suitable plastic material. Any low friction material known in the art may be used, without departing from the scope of the invention. The use of a harder material, such as metal for the first plates 116, 118 protects the second plate 120, 122 from the fasteners 124, 126. The sides of slide member 80 and/or the slot 98 could be made from a low friction material in addition or alternatively to the bushings 90, 92, plastic plates 120, 122, and/or washers 94, 96.

As the wheel 42 is rotated, the gear 60 is rotated as are the teeth 62 on the gear. Because the teeth 62 from the gear 60 are engaged with the teeth 76 from the rack 74, rotating the wheel 42 in a first direction, e.g. counterclockwise, will cause vertical linear movement of the rack, and thereby the slide member 80, e.g. up or raised, as seen by comparing FIGS. 3-4. As the wheel 42 is rotated in a second direction, e.g., clockwise, the rack 74 and slide member 80 are moved downward or lowered.

The amount, depth or force with which the teeth 62 of the gear 60 engage the teeth 76 of the rack 74 can be set by rotation of the nut 55. Because the threaded hole in nut 55 is offset or eccentric, peg 54 is attached to the nut 55 in an offset or eccentric manner, and so rotation of the nut will move the peg, and thereby, the wheel 42, gear 60 and teeth 62, toward or away from the rack 74. The hat bushing 53 allows the nut 55 to rotate, but not be removed from the side plate 56. A nut and offset peg could be attached to the frame of the sight apparatus in other ways without departing from the spirit of the invention. For example, the collar of the nut 55 could be threaded and screwed into a threaded hole in the side plate 56. A fastener could extend through a hole in the side plate to contact the nut 55 to prevent the nut from being further rotated and withdrawn from the nut when it is desired to rotate the nut.

The bushings 90, 92 are sized to fit or be slidably received in the slot 98 such that there is little to no play. Therefore, as seen most clearly in FIGS. 6-7, as the teeth 62 from the gear 60 engage with the teeth 76 from the rack 74, the interaction of the bushings 90, 92 within the vertical slot 98 causes the movement of the slide member 80 to be vertical in accordance with the slot.

The limits of vertical adjustment for the slide member 80, and thereby the scope head 144, can be set by the top bushing 90 contacting the top or first end 128 of the slot 98 and the bottom bushing 92 contacting the bottom or second end 130 of the slot.

Vertical adjustment could also be limited by the use of a catch 132 contacting a pin or projection 134. As seen in FIG. 2, the catch 132 is hook shaped and is attached to the adjustment member 16 with a fastener 136 that is threaded into one of a number of holes 138. The catch 132 also has an elongated slot 140 to allow further adjustment to the location of the catch. The pin 134 shown in FIG. 2 is attached to the slide member 80 such as being glued into a blind hole 142 in the slide member. The catch 132 can be positioned such that when the desired maximum amount of rotation in a direction is reached, the "up" direction in the embodiment shown in FIG. 4, the catch contacts the pin 134 to prevent any further movement of the slide member 80 in that direction, in this instance up, and thereby prevents any further rotation of the wheel 42 in a direction, in this instance counterclockwise. The pin 134 could also be adjustable, for example by having a number of holes in the slide member 80 or by being attachable to the slide member by fasteners similar to the catch 132.

Other methods for limiting the movement of the slide member 80 are known in the art, the use of which would not defeat the spirit of the invention. For example, the catch 132 and pin 134 could be integrally formed with the adjustment member 16 and slide member 80. By way of another example, vertical adjustment could be limited by the wheel 42, such as by the use of a catch on the adjustment member 16 contacting a pin on the interior side of the wheel or a pin on the adjustment member moving within a groove with ends defining the ends of rotation in the wheel.

The scope head or sight housing 144 is attached to the slide member 80 such that as the slide member moves up or down in response to the rotation of the wheel 42, the scope head also moves up and down to thereby selectively adjust the sight apparatus 10.

In the embodiment shown in FIG. 2, the scope head 144 is attached to the slide member 80 by an intermediate, selectively rotatable member 146. The front of the slide member 80 has a series of threaded holes 148 along its height as seen most clearly in FIG. 8. The intermediate member 146 has a through-hole 150 at its top and an elongated or slotted through-hole 152 at its bottom on a first side of the intermediate member. A first fastener 154 extends through the through-hole 150 and a second fastener 156 extends through the elongated through-hole 152, each of the fasteners engaging with one of the series of threaded holes 148 on the front of the slide member 80. In the embodiment seen in FIG. 2, the scope head 144 is attached to the intermediate member 146 by two fasteners 158, 160 that extend through holes 162, 164 in the intermediate member and into threaded engagement with holes 166, 168 in the keyway 192, respectively.

The series of threaded holes 148 on the front of the slide member 80 allows the intermediate member 146, and thereby the scope head 144, to be selectively placed. For example, if the sight apparatus 10 is intended to be used for long distance shots, the scope head 144 may be connected to the slide member 80 at two of the bottommost holes in the series of threaded holes 148 on the front of the slide member. Alternatively, if the sight apparatus 10 is intended to be used for short distance shots, the scope head 144 may be connected to the slide member 80 at two of the topmost holes in the series of threaded holes 148 on the front of the slide member.

Figure 5:
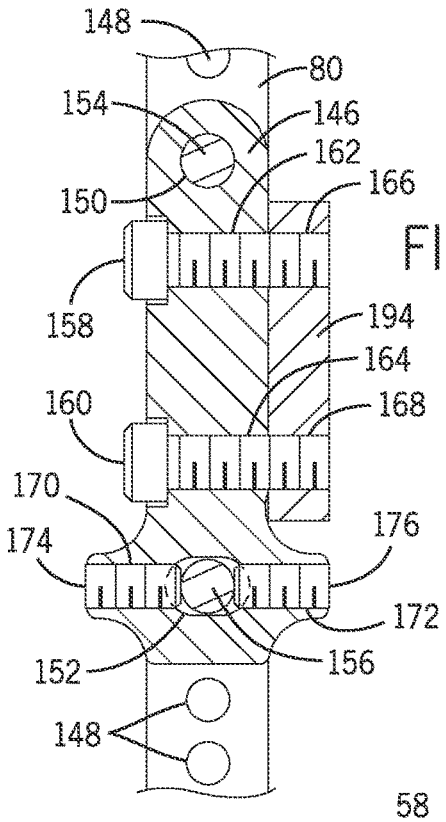
FIG. 5 is front elevation cross-sectional view of the sight apparatus of FIG. 3 taken along the line 5-5.
Figure 6:
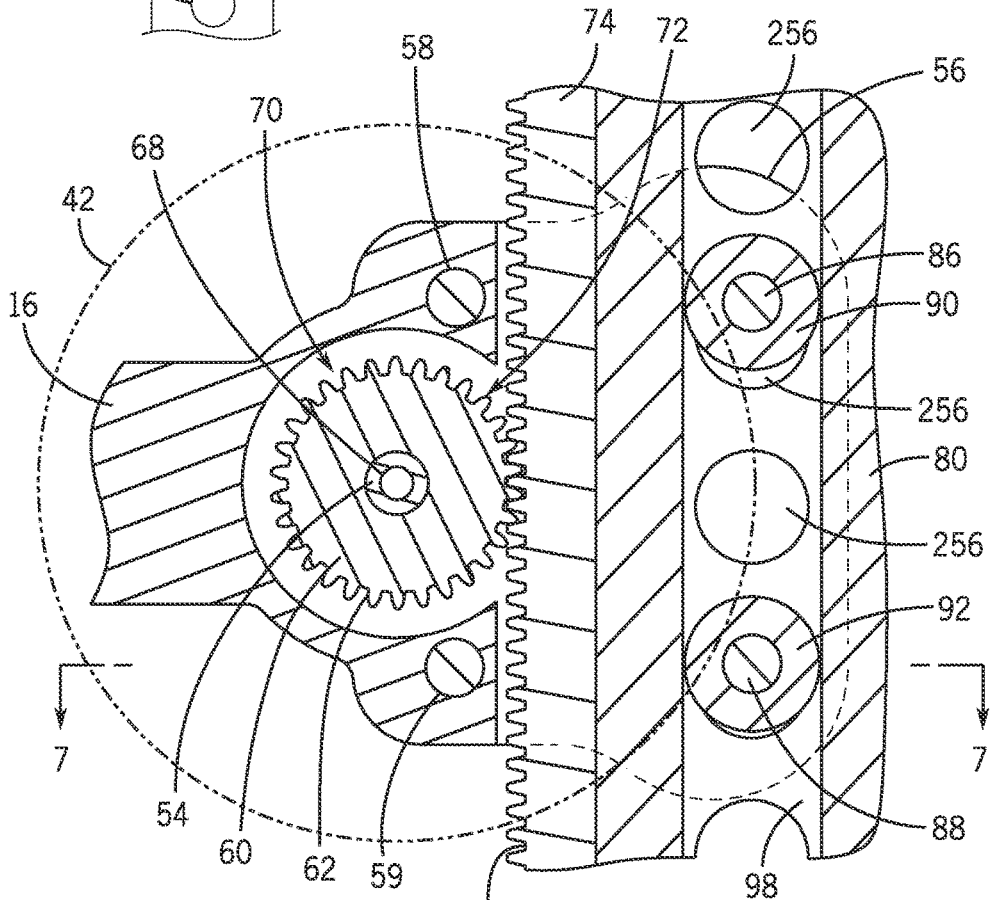
FIG. 6 is an enlarged partial elevation view of a portion of the sight apparatus of FIG. 1.

As can be seen by comparing FIG. 2 and FIG. 5, on each side of the elongated through-hole 152 of the intermediate member 146 are second and third sides adjacent the first side, each with a threaded hole 170, 172, respectively. Each threaded hole 170, 172 has a fastener or insert 174, 176 therein that allows the scope head 144 to be finely adjusted. For example, if the fastener 174 from the second side is threaded into the threaded hole 170 until it contacts the second or bottom fastener 156, further rotation of the fastener 174 into the threaded hole, e.g. clockwise, will cause the intermediate member 146, and thereby the scope head 144, to rotate about the first fastener 154 toward the second side because the through hole 152 is elongated. When the desired position of the scope head 144 is reached, the fasteners 154, 156 can be tightened down and both fasteners 174, 176 put into contact with the bottom fastener 156 to secure the scope head 144 to the slide member 80 and prevent further rotation, as seen best in FIG. 5.

The scope head 144 seen in FIG. 2 is similar to that described and disclosed in U.S. Pat. No. 7,360,313, having at least one sight pin 178 that is made from a material that is easy to see. In FIG. 2, the sight pin 178 is the end of an optic fiber, which optic fiber is wrapped 180 around the outside of the aiming ring 182 so as to absorb as much light as possible and make the sight pin 178 light up. The scope head 144 may also include a circular ring of paint 184 around the inside of the aiming ring 182, for ease of sighting a target. The scope head 144 also has a level 186.

In the embodiment shown in FIG. 2, the scope head 144 further includes a lateral adjustment mechanism 188 to allow the scope head to be adjusted laterally or horizontally to account for such factors as a crosswind and to accommodate the size of various firearms, weapons or similar equipment to which the sight apparatus 10 may be attached. In this embodiment, the lateral adjustment mechanism 188 includes a bar 190 attached to the aiming ring 182. The bar 190 extends through a keyway 192 in a keyway member 194. The end of the bar 190 opposite the aiming ring 182, is attached to a cap plate 196. The cap plate 196 has an opening through which a threaded post 200 extends, the threaded post engaging with a threaded hole 202 in the keyway member 194.

Figure 8:
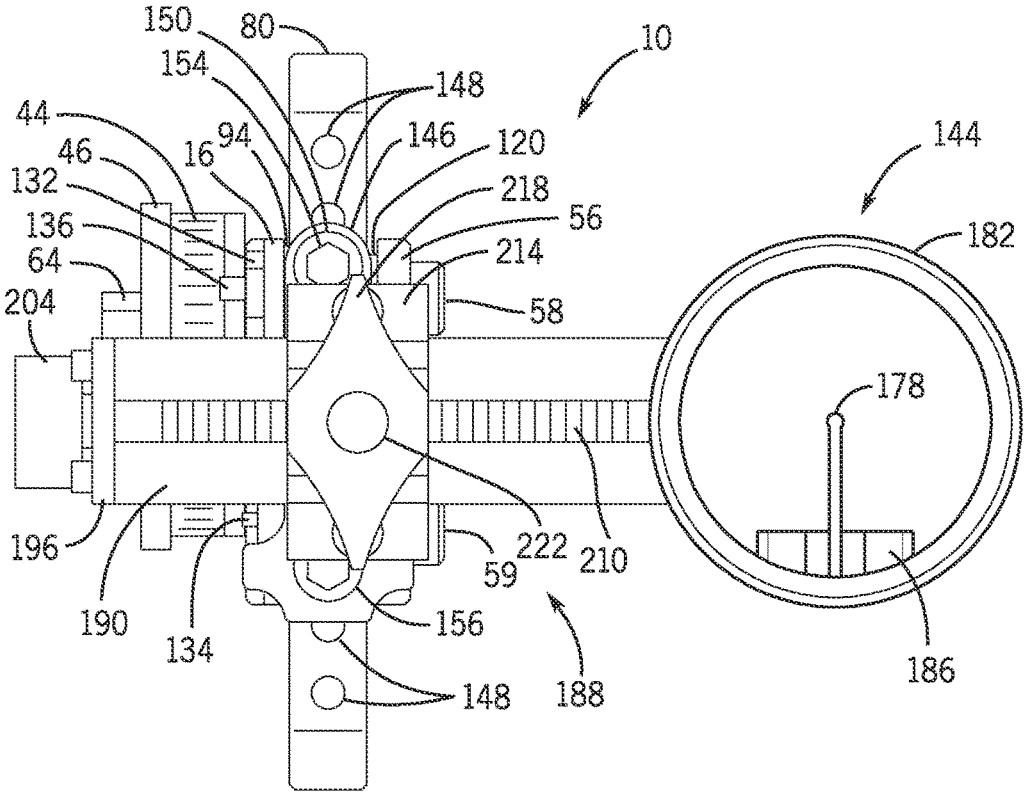
FIG. 8 is a front elevation view of the sight apparatus of FIG. 1.

A knob 204 is attached to the end of the post 200, e.g. via a threaded insert 206, such that the knob can be used to rotate the post. The knob 204, like the wing nut 218 explained more fully below, may be integrally formed with a threaded post or may be made separately and/or from a different material with desirable properties for the specific function of the knob, e.g. lighter weight aluminum. When the knob 204, and thereby the post 200, is rotated in a first direction, e.g. clockwise, the aiming ring 182 is moved in a first lateral or horizontal direction, e.g. away from the keyway member 194, via the bar 190 moving through the keyway 192. When the knob 204 is rotated in a second direction, e.g. counter-clockwise, the aiming ring 182 is moved in a second lateral or horizontal direction opposite the first direction, e.g. towards the keyway member 194. The bar 190 may have markings 210, or other indicia to indicate a unit of adjustment as seen in FIG. 8.

In order to aid in the movement of the bar 190 within the keyway 192, the bar and/or keyway could be made from materials that allow the two parts to move relatively easily and quietly with respect to each other. This could be accomplished in a number of ways including making the bar and or keyway from a low friction material, e.g. Teflon, nylon, or other suitable plastic material, or by adhering, screwing, bolting, welding, heat shrinking, insetting, fusing, bonding, over-molding, etc., such a material. In the embodiment shown in FIG. 2, a low friction material 212 has been glued to portions of the keyway 192.

The lateral adjustment mechanism 188 may also have a lock to prevent inadvertent use of the mechanism, resulting in undesired movement of the aiming ring 182. In the embodiment shown in FIGS. 2 and 3, the keyway member 194 has a keyway cap 214 attached to the keyway member by fasteners. The keyway cap 214 is generally 'U' shaped and holds a number of washers 216, e.g. spring washers, cone washers, Belleville washers or plates. The keyway cap 214 also has a threaded hole and the wing nut 218 attached to a threaded post 222, such as by a threaded insert 224, that is threaded into the wing nut 218 and contacts the threaded post. The wing nut 218 and threaded post 222 could be integrally formed. Having a separate wing nut and threaded post, however, allows the two components to be made from different materials. For example, the threaded post may be made of steel or other hard material that will reduce wear from being screwed and unscrewed, and the wing nut made from aluminum or other light material to reduce the overall weight of the sight apparatus 10. Further, the wing nut 218 may be permanently attached to the threaded post 222, such as by an adhesive, e.g. Loctite, welding or other method of attaching two such components, as can any other components which do not need the option of selective attachment and detachment, e.g. fasteners 154, 156. When the wing nut 218 is rotated in a first direction, e.g. clockwise, the threaded post 222 compresses the washers 216 against the bar 190 to prevent the bar from further movement. When the wing nut 218 is rotated in a second direction, e.g. counter-clockwise, the threaded post 222 allows the washers 216 to decompress, and the bar 190 may then be moved in response to rotation of the knob 204.

The face of the knob 204 facing toward the bar 190 may also have a cavity 226 wherein a spring 228 is located and a ball bearing 230. A series of detents or dimples 232 may be located around the hole 198 in the cap plate 196, which dimples are sized to fit a portion of the ball bearing 230. As the knob 204 is rotated, and thereby the ball bearing 230, the knob will make a clicking sound and feel as the spring 228 pushes the ball bearing into one of the dimples 232. These clicks may be correlated to units of displacements, e.g. one click equals an eighth of an inch at twenty yards.

The mounting of the wheel 42 to the peg 54 must be extremely certain and wear-proof so that as the wheel is rotated a certain amount, the sight pin 178 is moved by an extremely precise, predictable amount. Further, if a locking means is used with the wheel 42, it is also important that the wheel does not move as a result of the movement of locking and unlocking the locking means.

Figure 9:
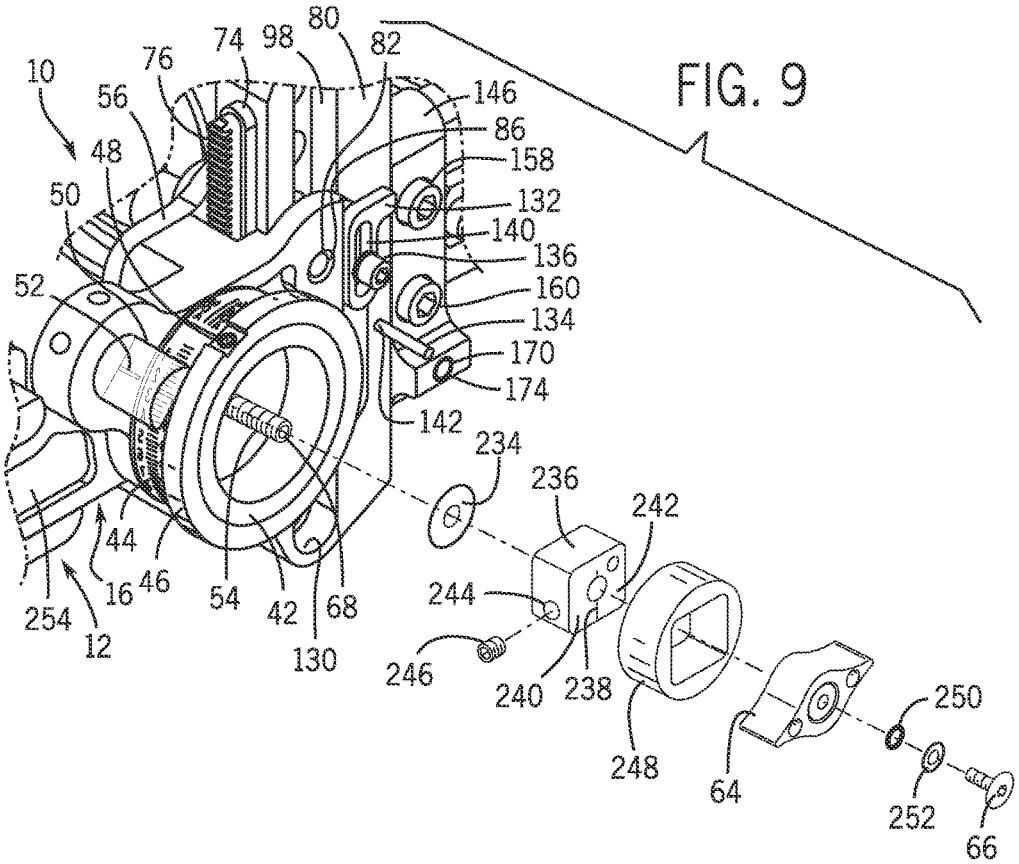
FIG. 9 is a partial exploded perspective view of the sight apparatus of FIG. 1.

One embodiment for accomplishing the desired level of certainty in the mounting is shown in FIG. 2, and shown in more detail in FIG. 9. After the wheel 42 has been placed on the peg 54, a washer 234 is slid onto the peg 54 and then a first nut 236 is screwed onto the peg, such as a square nut, and tightened so that the washer contacts the wheel. The square nut 236 may have a break or slit 238 from a first side to the center threaded opening so as to form a first leg 240 and second leg 242. An opening or bore 244 for an inset screw 246 is formed on the second side of the square nut or first leg 240 and extends through the first leg, past the break 238 and into the second leg 242, such that when the square nut is threaded onto the peg 54 and in its final position, the inset screw 246 may be threaded into the opening 244 on the first side of the square nut and tightened thereby pinching the legs 240, 242 together around the threaded post.

The wheel 42 will still be rotatable, with a certain amount of friction, when the square nut 236 is secured to the peg 54. A thrust washer 248, having a square opening that generally matches the size and shape of the square nut 236 but with a greater thickness, is then applied over the square nut, and a second nut or wing nut 64 is then threaded onto the peg 54. A rubber O-ring 250 is seated in a groove around the opening in the wing nut 64. As referred to above, screw 66 with a washer 252 is threaded into the threaded opening 68 at the end of the peg 54 to maintain the wing nut 64 on the post. When the wing nut 64 is tightened, moved or rotated to a first position, the thrust washer 248 will be pushed towards the wheel 42 and the friction applied thereby will be increased to the extent that the wheel will be prevented from rotating. When the wing nut 64 is loosened, moved or rotated to a second position, the thrust washer 248 will be released from the wheel 42 and the friction applied thereby will be decreased to the extent that the wheel can be rotated.

In order to adjust the rotational position of the wheel 42 (and thereby change the position of the slide member 80 and the sight pin 178 with respect to the adjustable member 16), the user would loosen the wing nut 64, rotate the wheel 42 as desired, and re-tighten the wing nut 64. The use of the thrust washer 248 around the square nut 236 focuses the small amount of contact friction from turning the wing nut 64 on the thrust washer instead of the square nut and thus prevents such friction from loosening the square nut. This allows the sight apparatus to be more accurate by reducing wiggle or play from the square nut 236 and thus the wheel 42.

In an alternate embodiment, as disclosed and described in FIG. 8 of U.S. application Ser. No. 14/061,216, a square nut could be threaded onto the peg 54 and a thrust washer with a square opening sized so as to just fit over the square nut placed over the square nut. Once tightened, the square nut is set in place by means of an inset screw that engages the peg 54. Thereafter, a matching thrust washer, again with a square opening sized so as to just fit over the square nut, is applied over the square nut. Finally, the wing nut 64 is threaded onto the peg 54 and a screw 66 can be threaded into the opening 68 at the end of the peg or a nut threaded onto the peg to hold the washers, nuts and wheel on the peg.

In another embodiment seen in FIGS. 10 and 11 of U.S. application Ser. No. 14/061,216, a hex nut, mounted within a thrust washer with a six-sided opening, is threaded onto the peg 54 and tightened so that the thrust washer contacts the wheel 42. A thrust washer, having a six sided opening that generally matches in size the hex nut, is then applied over the hex nut, and a wing nut 64 is then threaded onto the peg 54. A screw or nut can then be used to hold the washers, nuts and wheel on the peg.

As indicated, the tightening of the square nut 236 or hex nut is intended to hold the wheel generally in place, but permit rotation. The application and tightening of the wing nut 64 will prevent rotation of the wheel 42, once the sight apparatus 10 has been set up.

In order to reduce the weight of the sight apparatus 10, holes and/or cavities 254 can be formed in almost any of the parts or members. For example, in the embodiment shown in FIG. 2, cavities are formed in the adjustment member 16 and holes 256 are formed in the base of the slot 98. Holes and/or cavities can also be formed to hold other accessories as well. For example, the mounting member 12 has a hole 258 sized and shaped to hold a damper to help reduce vibrations and noise and increase accuracy.

To attach the sight apparatus 10 to a bow, for example, fasteners would be inserted through the mounting holes 14 and into the bow. The fastener 28 securing the mounting member 12 and the adjustment member 16 can be loosened and the threaded insert 40 used to adjust the scope head 144 such that the user is looking squarely into the scope head.

The fasteners 154, 156 on the intermediate member 146 can be loosened and the fasteners 174, 176 used, in combination with the level 186, to level and correctly orient the scope head 144. For example, to rotate the scope head 144 clockwise, when viewing the sight apparatus 10 in normal operation, the knob-side fastener 176 can be further threaded into the intermediate member 146 and the scope head-side fastener 174 unthreaded to permit rotation about the top fastener 154. When the scope head 144 is level, both fasteners 174, 176 should be snug against the bottom fastener 156 and the fasteners 154, 156 tightened. The knob 204 could be used to move the scope head 144 laterally or horizontally in relation to the adjustment member 16, to comfortably position the scope head and accommodate the size and shape of the bow.

To move the scope head 144, the wing nut 218 would be turned to an unlocked position and the knob 204 turned until the desired position for the scope head 144 was reached. When the desired position was reached, the wing nut 218 would be turned in the opposite direction to lock the bar 190 within the keyway 192 and thus prevent any further rotation of the knob 204 and undesired movement such as by being bumped or from the vibration of an arrow being shot.

In use, the wing nut 64 would be turned to an unlocked position and the wheel 42 turned to a desired setting, e.g. a distance, by looking at the indicator 50 and the indicia 44. When the desired setting was reached, the wing nut 64 would be turned in the opposite direction to lock the wheel 42 in place and prevent undesired movement such as by being bumped or from the vibration of an arrow being shot. If the lateral placement of the sight pin 178 is desired to be moved, the knob 204 can be used as described above.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A sight comprising:

a housing;

a wheel rotatably connected to the housing;

a circular gear connected to the wheel such that when the wheel is rotated the circular gear is rotated;

a slide member having a linear gear bar on a back side of the slide member, wherein the slide member is slidably retained within the housing and wherein the linear gear bar is engaged with the circular gear;

a sight pin connected to the linear gear bar by an intermediate rotatable member; and a washer in contact with a first side of the slide member adjacent the back side, wherein the washer is held in contact with the first side of the slide member by a fastener attached to the housing;

wherein rotation of the intermediate rotatable member causes rotation of the sight pin; and wherein rotation of the wheel causes linear motion of the sight pin.

2. The sight of claim 1 wherein the wheel has a lock mechanism, the lock mechanism movable between a first position wherein the wheel is prevented from moving and a second position wherein the wheel is not prevented from moving.

3. The sight of claim 1 wherein the linear gear bar has a slot and the housing has at least one projection slideably received within the slot and wherein the slot moves along the at least one projection when the wheel is rotated.

4. The sight of claim 1 wherein the linear gear bar is located between a first and second part of the housing and wherein at least one of a portion of the linear gear bar, the first part and the second part are made from a low friction material.

5. The sight pin of claim 1 wherein the intermediate rotatable member is rotatable about a fastener that connects the intermediate rotatable member to the linear gear bar.

6. The sight of claim 5 wherein the fastener is a first fastener and the intermediate rotatable member has a slotted hole formed therein; and wherein a second fastener further connects the intermediate rotatable member to the linear gear bar through the slotted hole;

wherein when the first and second fasteners are loosened, the intermediate rotatable member may rotate about the first fastener and the slotted hole moves with respect to the second fastener and when the first and second fasteners are tightened, the intermediate rotatable member is prevented from rotating.

7. The sight of claim 6 wherein the slotted hole is formed in a first side of the intermediate rotatable member and a threaded hole is formed in a second side adjacent the first side; and an insert received in the threaded hole engages the second fastener; wherein when the insert is turned in a first direction the intermediate rotatable member rotates in a direction towards the second side.

8. The sight of claim 1 wherein the housing further comprises:

a first part having a first plate adjustably held by the first part, the first plate being adjustable by a first threaded insert; and a second part having a second plate adjustably held by the second part, the second plate being adjustable by a second threaded insert;

wherein the linear gear bar is slideably positioned between the first plate and the second plate; and wherein an amount of force applied to the linear gear bar by the first and second plates can be adjusted by at least one of the first threaded insert and the second threaded insert.

9. A sight comprising:

a housing;

a wheel rotatably connected to the housing by a post;

a lock knob connected to the post such that the lock knob can be moved between a first position wherein the wheel cannot be rotated and a second position wherein the wheel can be rotated;

a circular gear connected to the wheel such that when the wheel is rotated the circular gear is rotated;

a first part having a first plate and a second plate, the first plate and second plate adjustably held by the first part, the first plate being adjustable by a first threaded insert and the second plate being adjustable by threaded insert;

a linear gear bar slidably retained within the housing, the linear gear bar engaged with the circular ear and slideably positioned between the first plate and the second plate; and a sight pin connected to the linear gear;

wherein rotation of the wheel causes linear motion of the sight pin; and wherein an amount of force applied to the linear gear bar by the first and second plates can be adjusted by at least one of the first threaded insert and the second threaded insert.

10. A sight comprising:

a housing;

a peg rotatably attached to the housing by a nut, the peg being eccentrically secured to the nut;

a wheel rotatably connected to the housing by the peg;

a circular gear connected to the wheel such that when the wheel is rotated the circular gear is rotated;

a linear gear bar slidably retained within the housing, the linear gear bar engaged with the circular gear; and a sight pin connected to the linear gear;

wherein rotation of the wheel causes linear motion of the sight pin; and wherein the wheel can be adjusted with respect to the housing by rotation of the nut.

11. A sight comprising:

a housing;

a peg extending from the housing to rotatably connect the wheel to the housing;

a circular gear connected to the wheel such that when the wheel is rotated the circular gear is rotated;

a linear gear bar slidably retained within the housing, the linear gear bar engaged with the circular gear;

a sight pin connected to the linear gear;

a first nut engaging the peg such that the first nut secures the wheel with respect to the peg while still allowing the wheel to rotate;

at least one washer with an opening formed therein sized and shaped such that the first nut may fit at least partially in the opening; and a second nut engaging the peg such that when the second nut is tightened the second nut contacts the washer and prevents the wheel from rotating and when the second nut is loosened the wheel may be rotated;

wherein rotation of the wheel causes linear motion of the sight pin.

12. The sight of claim 11 wherein the first nut is a square nut, the square nut further comprising:

a slit formed in one side of the square nut to create a first leg and second leg of the square nut;

a bore formed through the first leg and at least partially into the second leg;

a screw sized to engage the bore to secure the square nut on the peg.

13. A sight for a bow comprising:

a frame for mounting the sight to the bow;

a dial rotatably connected to the frame;

a pinion attached to the dial such that when the dial rotates, the pinion rotates;

a slide member with a rack, the rack engaged with the pinion, such that when the pinion rotates in a first direction the rack is raised and when the pinion is rotated in a second direction the rack is lowered; and a sight housing having a sight pin, the sight housing attached to the slide member such that the sight housing moves with the slide member;

wherein the slide member has a groove formed therein and a bushing attached to the frame is engaged with the groove; and wherein the groove has a first end and a second end and wherein a limit to which the rack may be raised is defined by the bushing reaching the first end and a limit to which the rack may be lowered is defined by the bushing reaching the second end.

14. The sight of claim 13 wherein the slide member has a projection and the frame has catch such that a limit to at least one of an amount the rack can be lowered and raised is defined by the catch contacting the projection.

15. The sight of claim 13 further comprising a locking means movable between a first position and a second position, wherein when the locking means is in a first position the dial is prevented from rotating and when the locking means is in a second position, the dial may rotate; and wherein the locking means may be moved between the first position and the second position without rotation of the dial.

16. The sight of claim 13 further comprising a spool selectively attached to the dial such that when the spool is rotated the dial is rotated, the spool having a measurement system.

17. A sight for a bow comprising:

a frame for mounting the sight to the bow;

a dial rotatably connected to the frame;

a pinion attached to the dial such that when the dial rotates, the pinion rotates;

a slide member having a rack, the rack engaged with the pinion, such that when the pinion rotates in a first direction the rack is raised and when the pinion is rotated in a second direction the rack is lowered;

a plate attached to the frame, the plate in contact with the slide member; and a sight housing having a sight pin, the sight housing attached to the slide member such that the sight housing moves with the rack;

wherein the sight housing is rotatably attached to the slide member by a selectively rotatable member, the selectively rotatable member being selectively rotatable about a fastener that attaches the selectively rotatable member to the slide member wherein the plate applies an adjustable force on the slide member and adjustment of a fastener changes the adjustable force applied to the slide member by the first plate.

18. A sight comprising:

a housing that includes:

a mounting portion for attaching the sight to a bow;

an adjustable portion connected to the mounting portion, the adjustable portion having an aperture formed therein, and a top and bottom bushing and a top and bottom washer secured to the adjustable portion; and a side plate connected to the adjustable portion, the side plate having an adjustable top plate and an adjustable bottom plate;

a vertical gear having a vertical slot formed therein, the top and bottom bushing slidably received in the vertical slot, the vertical gear held between the side plate and adjustable portion by the top and bottom washers and the adjustable top and bottom plates;

a cylindrical handle connected to at least one of the side plate and adjustable portion by a post, the cylindrical handle having a spur gear located within the aperture and engaged with the vertical gear;

a lock nut threaded onto the post and secured to the post by an inset screw threaded into a bore of the lock nut;

a washer sized to snugly fit around the lock nut;

a wing nut threaded onto the post, wherein when the wing nut is tightened, the wing nut contacts the washer to thereby prevent the cylindrical handle from rotating with respect to the post;

an intermediate member rotatably connected to the vertical gear by a fastener; and a scope head attached to the intermediate member;

wherein when the fastener is loosened, the intermediate member and scope head can be rotated about the fastener and when the fastener is tightened the intermediate member and scope head cannot be rotated;

wherein when the cylindrical handle is rotated in a first direction, the spur gear is rotated in the first direction and the engagement between the spur gear and the vertical gear causes the vertical gear and scope head to move upward and when the cylindrical handle is rotated in a second direction, the spur gear is rotated in the second direction and the engagement between the spur gear and the vertical gear causes the vertical gear and scope head to move downward; and wherein the top and bottom washers, adjustable top and bottom plates and top and bottom bushings are made from a low friction material.

* * * * *